US009453332B2

(12) United States Patent
ter Huurne

(10) Patent No.: US 9,453,332 B2
(45) Date of Patent: Sep. 27, 2016

(54) BUILDING SYSTEM, PARTICULARLY A RESIDENTIAL BUILDING

(71) Applicant: Andre ter Huurne, Hamburg (DE)

(72) Inventor: Andre ter Huurne, Hamburg (DE)

( * ) Notice: Subject to any disclaimer, the term of this patent is extended or adjusted under 35 U.S.C. 154(b) by 0 days.

(21) Appl. No.: 14/436,347

(22) PCT Filed: Sep. 12, 2013

(86) PCT No.: PCT/EP2013/068893
§ 371 (c)(1),
(2) Date: Apr. 16, 2015

(87) PCT Pub. No.: WO2014/060155
PCT Pub. Date: Apr. 24, 2014

(65) Prior Publication Data

US 2015/0267395 A1 Sep. 24, 2015

(30) Foreign Application Priority Data

Oct. 17, 2012 (EP) ..... 12188775

(51) Int. Cl.

| | |
|---|---|
| ***E04B 1/26*** | (2006.01) |
| ***E04B 1/343*** | (2006.01) |
| ***E04B 2/70*** | (2006.01) |
| ***E04C 2/296*** | (2006.01) |
| ***E04B 2/00*** | (2006.01) |
| *E04B 2/96* | (2006.01) |

(52) U.S. Cl.

CPC ..... *E04B 1/26* (2013.01); *E04B 1/2604* (2013.01); *E04B 1/34321* (2013.01); *E04B 1/34384* (2013.01); *E04B 2/70* (2013.01); *E04C 2/296* (2013.01); *E04C 2/46* (2013.01); *E04B 2/96* (2013.01); *E04B 2001/2628* (2013.01); *E04B 2001/2664* (2013.01); *E04B 2103/04* (2013.01)

(58) Field of Classification Search

CPC .. E04B 1/26; E04B 1/34321; E04B 1/34384; E04B 2/70; E04C 2/296
USPC ..... 52/235, 43.1, 653.1
See application file for complete search history.

(56) References Cited

U.S. PATENT DOCUMENTS

| | | | | |
|---|---|---|---|---|
| 3,338,011 | A * | 8/1967 | Schneller | E04B 2/70 52/282.4 |
| 7,138,166 | B2 * | 11/2006 | Rinehart | B32B 17/10036 428/99 |
| 2006/0260268 | A1 * | 11/2006 | Ritchie | E04B 1/942 52/783.1 |
| 2011/0305868 | A1 * | 12/2011 | Heytens | C04B 28/02 428/116 |
| 2013/0055669 | A1 * | 3/2013 | Olszewski | B32B 3/06 52/283 |
| 2013/0071604 | A1 * | 3/2013 | Lemieux | B32B 3/02 428/71 |

FOREIGN PATENT DOCUMENTS

| | | |
|---|---|---|
| DE | 29918219 | 8/2000 |
| DE | 10357052 | 6/2004 |
| DE | 102005058386 | 6/2007 |
| EP | 0008713 | 3/1980 |

* cited by examiner

*Primary Examiner* — Brian Mattei
*Assistant Examiner* — Paola Agudelo
(74) *Attorney, Agent, or Firm* — Thomas M. Freiburger

(57) ABSTRACT

The system has filling plates (10) that are provided between an inner cover plate and outer cover plate. The frame rails are formed with an intermediate trapped insulation. A connection element configured for connecting the posts and bolt so that the filling plates are provided in the skeletal segments. An outer edge of the outer cover plate of a filler panel is overlapped adjacent to the post or bolt. The connecting portion configured to jam the overlapping portions of the outer cover plate with post or bolt.

17 Claims, 8 Drawing Sheets

BUILDING SYSTEM, PARTICULARLY A RESIDENTIAL BUILDING

The invention relates to a building system, in particular to a residential building, according to the preamble of claim 1.

Smaller buildings, such as residential buildings or holiday homes, can be erected in a variety of ways. Traditionally, residential buildings have been—and still are—as a rule erected with walls from brickwork, which nowadays is mostly produced as double walls with insulation or an air layer present between the walls.

Also, prefabricated houses are known, wherein the outer walls are initially produced in a factory and are then assembled on the building site to form a building structure with the aid of a crane. In the case of larger buildings, the walls may also be formed from smaller modules that are not assembled into larger wall modules until after delivery to the building site. During the production of prefabricated houses, the wall panels are as a rule formed from concrete slabs which are joined to each other on the end sides. As a result, butt joints are obtained that have to be suitably concealed, for example by applying an exterior rendering once the building has been finished, or by designing the butt joints in such a way that they create the appearance of a skeleton structure made from supports and crossbeams.

In the timber construction area, prefabricated houses are also known which immediately use a skeleton structure, similar to a timbered house made from supports, girders and crossbeams, which form the supporting framework for receiving the load of the ceilings, of the roof and of the wall elements. The skeleton fields are provided with fillings, windows and doors. In this respect it is also known to use finished wall elements as load-bearing elements. Such elements are made from a wooden frame with outer and inner panels, between which a skeleton for bracing is provided.

However, in the construction of prefabricated houses there is still a desire to be able to produce the building system as far as possible in a factory and to minimize the effort required for erecting the building. As a rule, finished wall elements can be assembled into a complete building with the aid of a crane within a few hours. However, the slab elements used are so large and heavy that they can be handled only with considerable machine effort, and a large amount of manpower is required in order to align, to connect and to rework the slab elements. This work can be carried out only by qualified specialists, but by no means by the house owner without suitable machine support.

From DE 103 57 052 A1, a building system is known that shows a skeleton structure consisting of posts and crossbeams, wherein the skeleton fields are provided with cover panels. The cover panels are fastened on the front side to the posts and crossbeams using fastening means, by clamping these fastening means to the posts or crossbeams using appropriate fittings.

In this document, the building frame is formed from steel girders which are welded together at the intersections.

However, it is the aim of the invention to be able to erect a building system, in particular a residential building, with elements that can be substantially handled with muscle power, that can be coupled to each other in a simple manner, the weight of which does not exceed a certain limit, but which still allow a building to be erected in a rapid, effective and low-cost manner. Further, the elements used are supposed to be designed such that the building system can be retrospectively modified and can also be disassembled substantially without any damage and be reassembled in another place.

The invention is therefore based on the object of providing a building system, in particular a residential building, from a skeleton structure that can be simply and quickly erected, that can be designed in a variable and low-cost manner and that can be disassembled and reassembled again.

This object is achieved by means of the invention as indicated in claim 1. Advantageous developments of the invention are indicated in the dependent claims.

The invention is based on a building system having a skeleton structure from posts and crossbeams erected on a ground slab, wherein the skeleton fields are provided with typified filling panels, windows and doors.

According to the invention, the typified filling panels are formed in multiple layers with an inner cover plate, an outer cover plate and a frame strip running between the inner cover plate and the outer cover plate with insulation enclosed therebetween. The connecting means for connecting the posts and crossbeams with the filling panels, which are in alignment therewith, in the skeleton fields are formed as detachable fittings. Each outer edge of the outer cover plate of a filling panel overlaps the adjacent posts or crossbeams at least in part, and the connecting means clamp the regions of the outer cover panels that overlap the posts or crossbeams.

By the invention filling panels and connecting means are characterised that can be inserted into a skeleton structure made from posts and crossbeams, wherein the filling panels can simply be inserted into the skeleton fields as standardized finished elements and can be fastened to the posts and crossbeams by means of connecting means per se known. In this respect, the filling panels are not permanently fastened in the skeleton fields, but merely clamped to the crossbeams or posts, so that the filling panels can be detached at any time and the building can be designed in a different way.

The filling panels are designed as double-wall structures with circumferential frame strips. In the cavity thus formed, insulation material is provided. Since the outer cover plate at least partially overlaps the adjacent posts and crossbeams, an almost homogenous outer structure of a building wall can be produced in this way, which only includes fittings that cover the butt joints of the adjacent outer cover plates. The fastening of the filling panels to the posts or crossbeams is therefore only carried out on the outside of a wall, whereas the filling panels on the inside may remain unfastened.

The typification of the filling panels allows them to be produced at low costs in a factory. However, such filling panels are still formed as small wall elements that can still be handled, the weight of which is determined such that they can be carried and installed by no more than two people.

The posts and crossbeams used are formed with a T-shaped cross section, wherein their web height corresponds to the overall thickness of the insulation and the inner cover plate. The T-shaped posts or crossbeams have here an attached flange that protrudes over the edge on the inside of the inner cover plates of the filling panels, which are adjacent to the posts or crossbeams.

As a result of the fact that the flanges of the T-shaped posts or crossbeams are located on the inside of a wall, it becomes possible to insert the filling panels from the outside into the skeleton fields, so that they come to rest against the inner side of the flanges.

The flanges of the filling panels preferably have such a thickness that front wall panels can be fastened to the top edges of the flanges of a wall, which are located in one plane, e.g. plasterboard panels, which thus enable a continuous inner wall without any protruding elements to be produced.

As a result, a cavity corresponding to the thickness of the flanges is located between the inner cover plates of the filling panels and the front wall plates, in which domestic installations such as water and heating pipes as well as electric cables can be accommodated. The installation space can also be at least partially filled with an insulation material.

A building according to the invention will preferably be erected without a basement on a cast or laid concrete slab. Preferably, the walls of the building are erected on the ground slab from floor joists made from crossbeams. On the top side of the walls, the walls are preferably covered with a plate formed from interconnected crossbeams, onto which plate ceiling girders can be placed. Also, the roof structure can be placed onto the plate or onto an eaves purlin.

The ceiling girders are preferably connected to the longitudinal plate via interengaging hooked fittings. Such hooked fittings can be coupled to each other in a simple manner and can, if desired, also be disconnected again. Preferably, a first part of the hooked fitting is fastened to an edge beam that is placed on the plate. The second part of the hooked fitting is located at the end of the respective ceiling girder. The sub-elements of the hooked fitting can respectively remain on the ceiling girders or the edge beams even if the building is to be disassembled again.

The posts and crossbeams are in particular made from glued wood. The crossbeams running horizontally and forming the plate and the edge beams placed thereon are also preferably made from glued wood. The advantage of glued wood especially consists in the fact that the desired cross sections can be produced in a simple manner, that wood pieces produced in this way are substantially torsion-resistant and that glued wood structures can be produced in a low-cost manner.

The typified filling panels according to the invention cannot only be used as wall panels, but they can also be used as ceiling panels between the ceiling girders. In the case of the use of ceiling panels it may be prudent to halve the grid distance of the ceiling girders compared to the grid distance of the wall posts and thus also to halve the width of the ceiling panels compared to the wall filling panels, in order to make the ceiling accessible.

For the production of the filling panels, their inner cover plates are preferably designed as OSB chipboards and the outer cover plates from vapour diffusive DWD panels, preferably from MDF fibre material. DWD panels have the property of being vapour permeable, but waterproof, so that they can be used as outer wall panels.

Part of the skeleton fields of the walls of the building may be provided with windows that can be opened or with permanently installed glass plates. The latter may be clamped to the posts and crossbeams in the same way as the outer cover plates.

The connection of the posts and crossbeams with each other is preferably carried out with sliding fittings on the end side, which are covered on the outside and are fastened to the crossbeams, which sliding fittings can be inserted into corresponding fittings on the posts. In this way it can be achieved that these connection fittings are visible neither from the outside of the building nor from the inside thereof, but still allow a permanent connection between the post and the crossbeam.

The detachable fittings for connecting two outer cover plates, door or window frames or glass plates with the crossbeams or posts preferably consist of a support strip that covers the bottom side of the shafts of the T-shaped posts or crossbeams and is provided with an inner seal, and of an outer strip provided with a further seal, which are clamped to each other via bolts, wherein they each clamp the outer edges of two outer cover plates or glass plates to each other. The clamping can be readily achieved and released by means of screw connections. For the outer covering, the fittings may be covered with an outer cover strip.

With the building system according to the invention it is possible to design almost all of the wall elements, posts, crossbeams or beams to be used as pieces that are so small that their respective weight does not exceed 80 kg, so that they can readily be carried and handled by two people. All the wall elements are merely screwed or clamped together, so that they can easily be assembled or disassembled. Such a building can therefore be erected by the house owner him/herself, without the use of a crane. The individual components are prepared to such a degree that they can, with appropriate pre-planning and adhering to the building instructions, be assembled in a simple manner and can be erected to form the finished building. As mounting tools, only the usual tools available to an experienced "do-it-yourselfer" are required.

The skeleton structure of the building consists of posts arranged vertically in the grid dimension and horizontally running crossbeams also arranged in the grid dimension, which are connected to each other via interengaging fittings. The posts and crossbeams to be used are designed to be identical as far as possible and have the same cross sections. All the filling panels are also formed in the grid dimension, so that they substantially differ only in their height.

Such a building can be disassembled again at any time. Since the inner walls of the building system may also be designed in a skeleton structure with inserted filling panels, the inner structure of the building can also be modified in a simple manner.

The invention will be explained in more detail below by means of an embodiment example, wherein.

Figure 1:
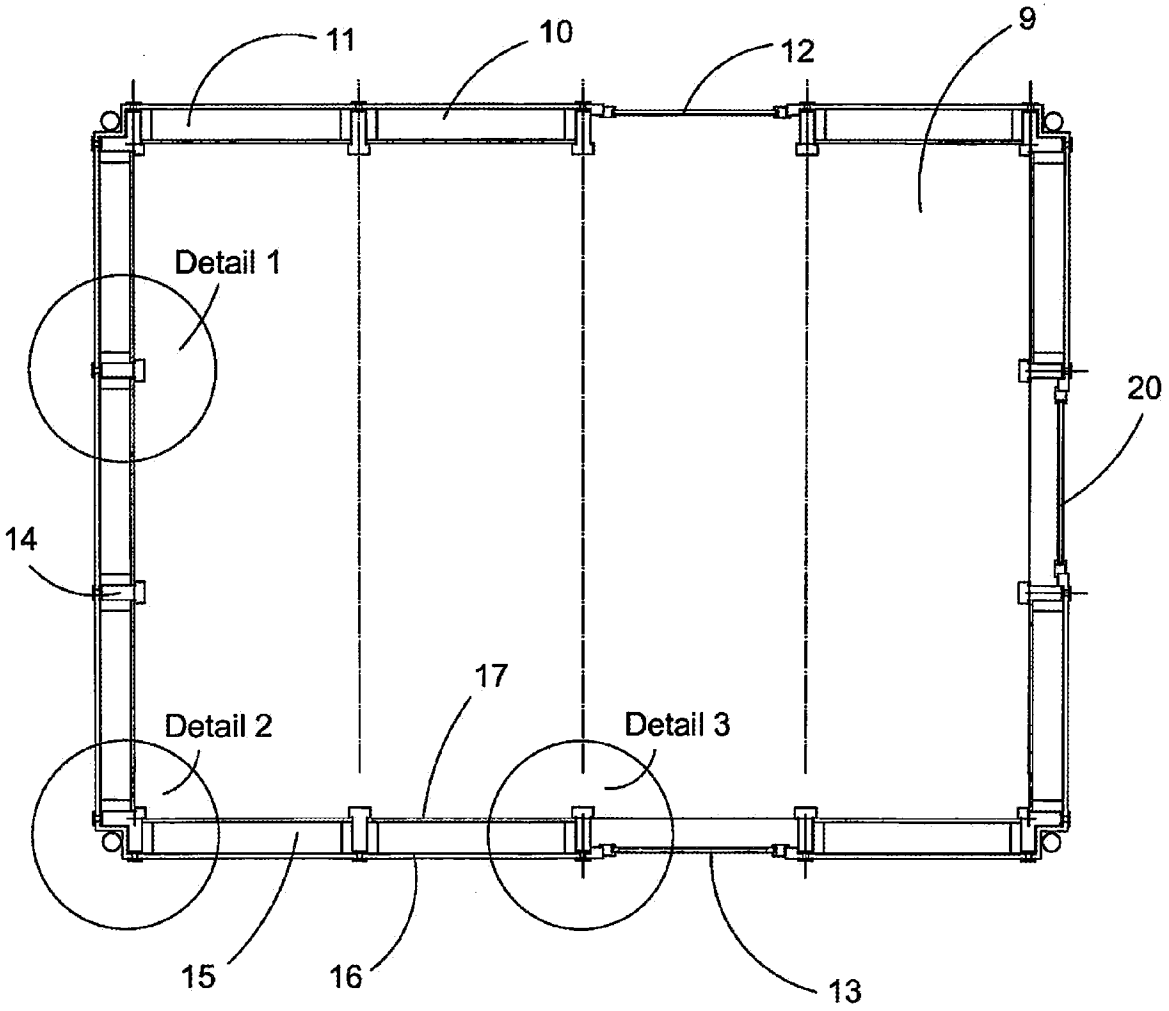
FIG. 1 shows a layout of a model house.

The view shown in FIG. 1 shows a ground slab 9 that is either produced on foundation insulation 34 as a prefabricated slab or is cast on site as a concrete slab. Prior to that, all site connections for gas, water, electricity, etc. have been established.

The production of the ground slab and of the supply and discharge connections is in particular carried out by the supplier of the building system.

Initially, a base crossbeam 36 is placed on the ground slab 9. The circumferential ground crossbeam 36 forms the underside of the walls and surrounds the screed 18. In a vertical direction, posts 14 are erected on the circumferential base crossbeam 36, which have a fixed lateral distance from each other. In one embodiment example, the grid distance is 1.25 m, so that in the case of 4 posts in the transverse direction and 5 posts in the longitudinal direction, the overall length of the building is 5 m and its width is 3.75 m.

Filling panels 10, 11 are inserted between the posts 14, which are formed as typified prefabricated elements having a width of approx. 1.13 m and a height of approx. 78 cm. The filling panels consist of an outer cover plate 16, an inner cover plate 17 and an insulation 15 provided between them, as will be explained in more detail below.

The building also includes windows/doors 12, 13 and an entrance door 20, the width of which also corresponds to the grid dimension between two posts. The details 1, 2, 3 of FIG. 1 will be explained in more detail in subsequent drawings.

Figure 2:
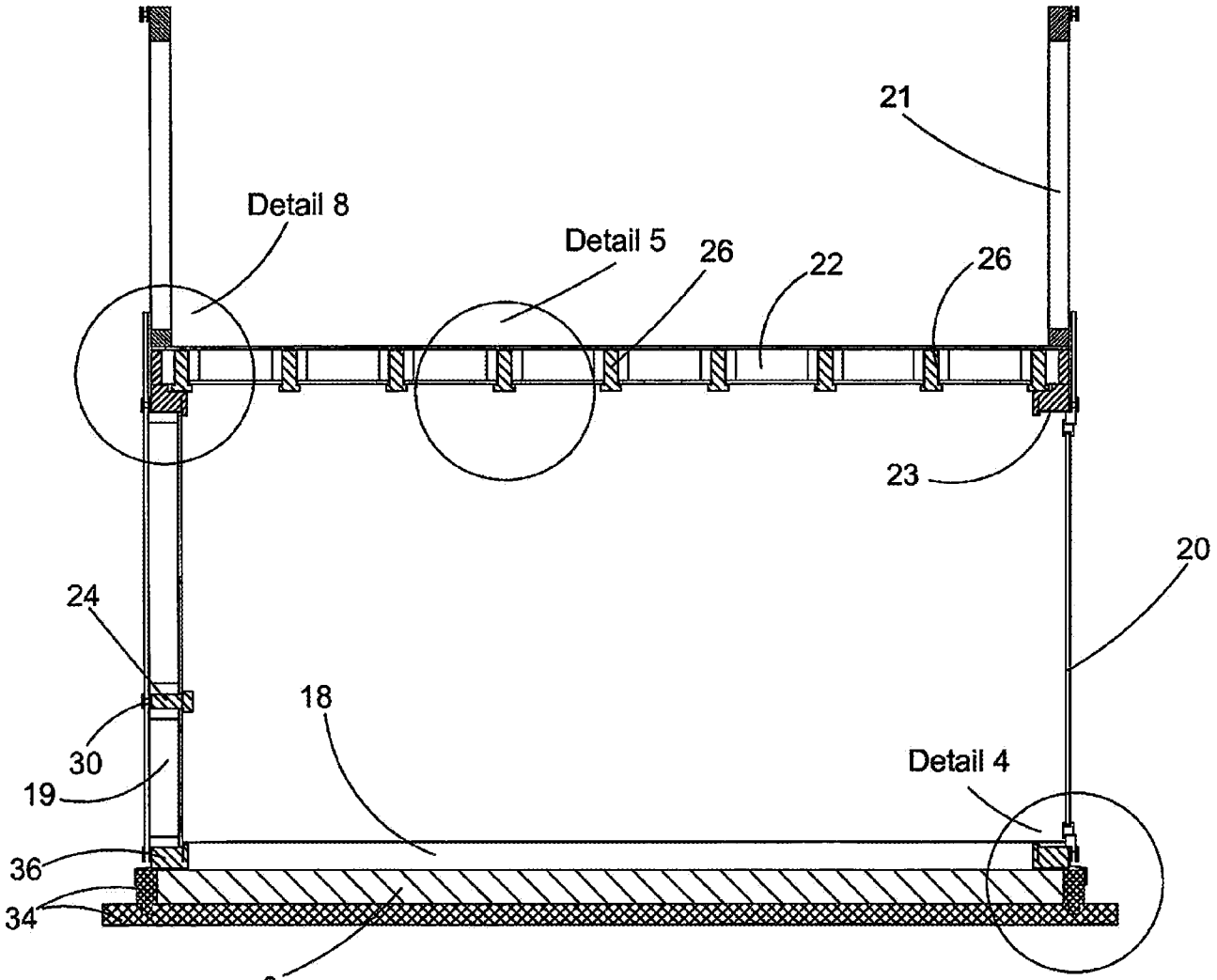
FIG. 2 shows a vertical lateral cross section of a model house.

FIG. 2 shows the building system in a vertical sectional view. The representation shows the cross section of a wall with a crossbeam 24 and a bottom filling panel 19 and a filling panel provided above the crossbeam 24, which has e.g. twice the height of the bottom filling panel 19. On the opposite side, the entrance door 20 having a full wall height is provided. The walls are covered by a plate 23 that carries the ceiling girders 26 which are made up from individual crossbeams, between which also filling panels 22 are inserted as a ceiling. The gables 21 are supported on the plate.

Figure 3:
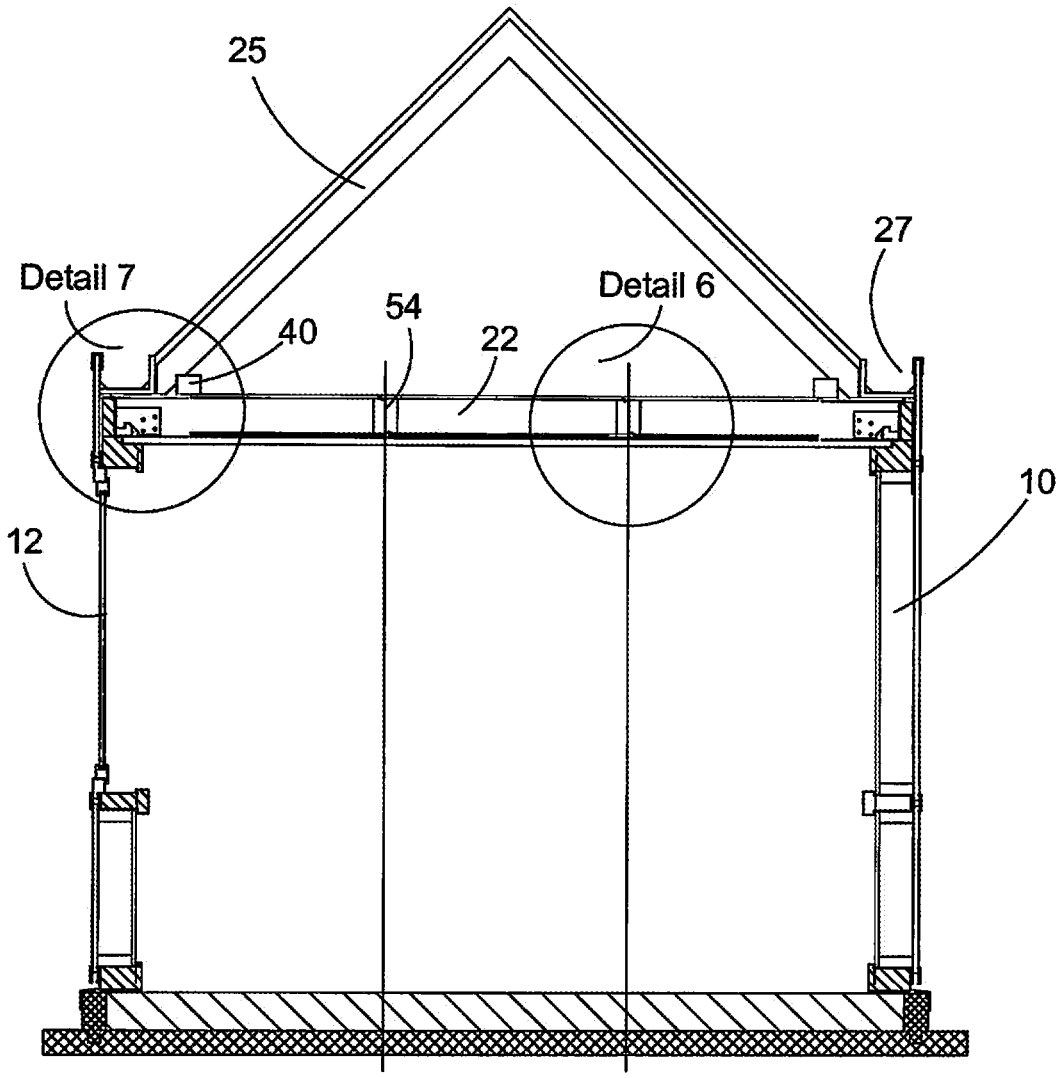
FIG. 3 shows a vertical cross section of a model house.

FIG. 3 shows a vertical cross-sectional view of the building. The rafters 25 are supported on the plate or an eaves purlin 40. The building includes oppositely arranged windows 12 and 13.

Figure 4:
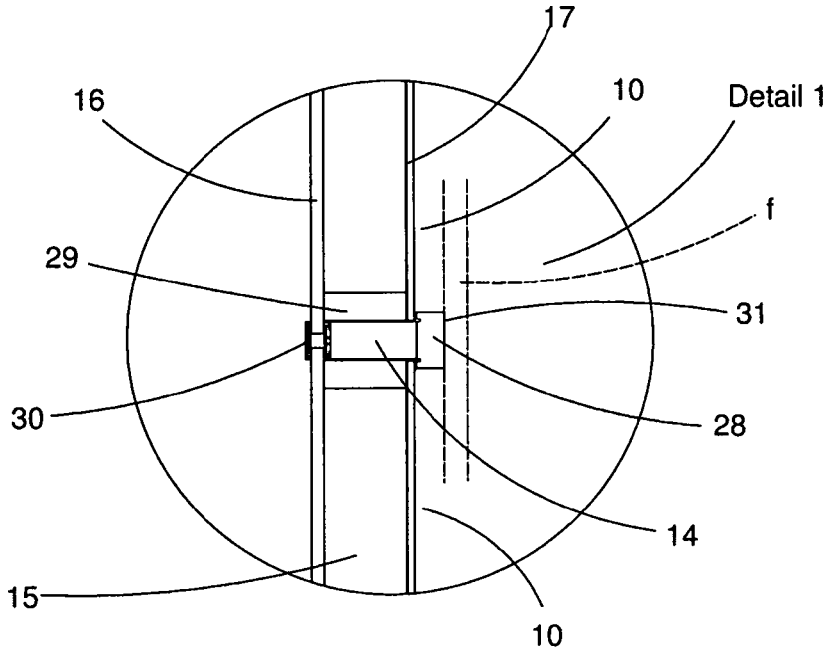
FIG. 4 shows a connection of filling panels and posts.

FIG. 4 shows a detailed view 1 from FIG. 1. This view shows a post 14 that is formed as a T-shaped post with a web and a flange 28. On either side of the flange, there are filling panels 10, each of which is made from an inner cover plate 17, an outer cover plate 16, an edge-side frame strip 29 and insulation 15 between them, and which are produced as rigid, prefabricated, typified units.

The filling panels 10 are inserted from the outside into the skeleton formed by posts and crossbeams, wherein the inner cover plates 17 abut against the inside of the flanges 28 of the posts 14. Since the crossbeams are also correspondingly produced as T-shaped glued wood products having the same cross section as the posts, the inner cover plates 17 of each filling panel abut circumferentially against the inside of the flanges 28. On the outside of the filling panels 10, the edges of the outer cover plates 16, which are formed to be slightly larger than the inner cover plate 17, overlap the webs of the posts 14 and the crossbeams 24. The connection of the filling panels 10 with the posts 14 is carried out by means of fittings 30 which clamp the edges of the outer cover plates 16 with the bottom sides of the webs of the posts 14. In this way, stable wall structures can be made from relatively small elements.

The top edges 31 of the flanges 28 of the posts and the crossbeams 24 have such a distance from the surfaces of the inner cover plates 17 of the filling panels 10 inserted into the skeleton structure, that installations can be erected on the inner cover plates which can subsequently be covered up by cover panels of front panels f such as e.g. plasterboard panels, which are fastened to the top edges 31 of the flanges 28. Thus, smooth inner structures result on the inside of the building, without any installations such as cables or conduits interfering with the wall structures.

Figure 5:
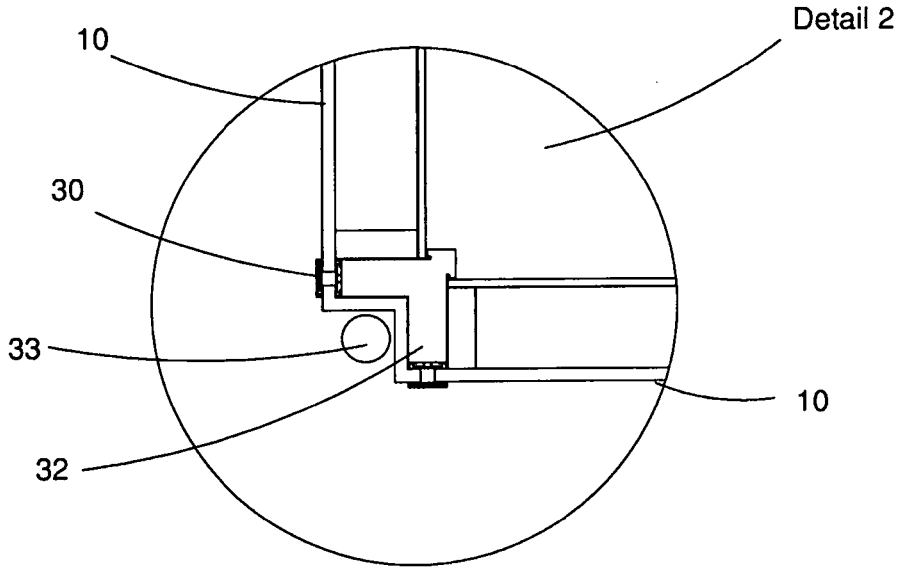
FIG. 5 shows a corner formation.

FIG. 5 shows a corner view of the building system. The corner post 32 is substantially made up from two T-shaped posts, wherein the two webs offset by 90° each include a fitting 30 for connecting with adjacent filling panels 10. A downpipe 33 can be inserted into the corner formation on the outside.

Figure 6:
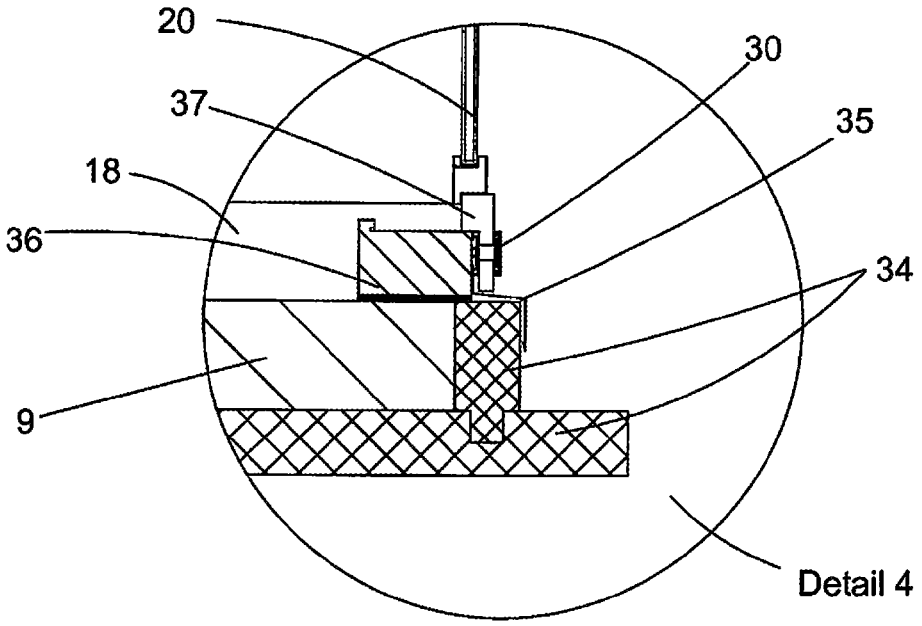
FIG. 6 shows a door/window design, horizontally

FIG. 6 shows the design of the underside of a wall in the region of a door 20. The base crossbeam 36 rests on the ground slab 9 that is provided with insulation 34 on the bottom side and the edge side. The screed 18 forms the floor of the building. By means of a fitting 30, the door 10 frame 37 can be fastened to the base crossbeam 36.

Figure 7:
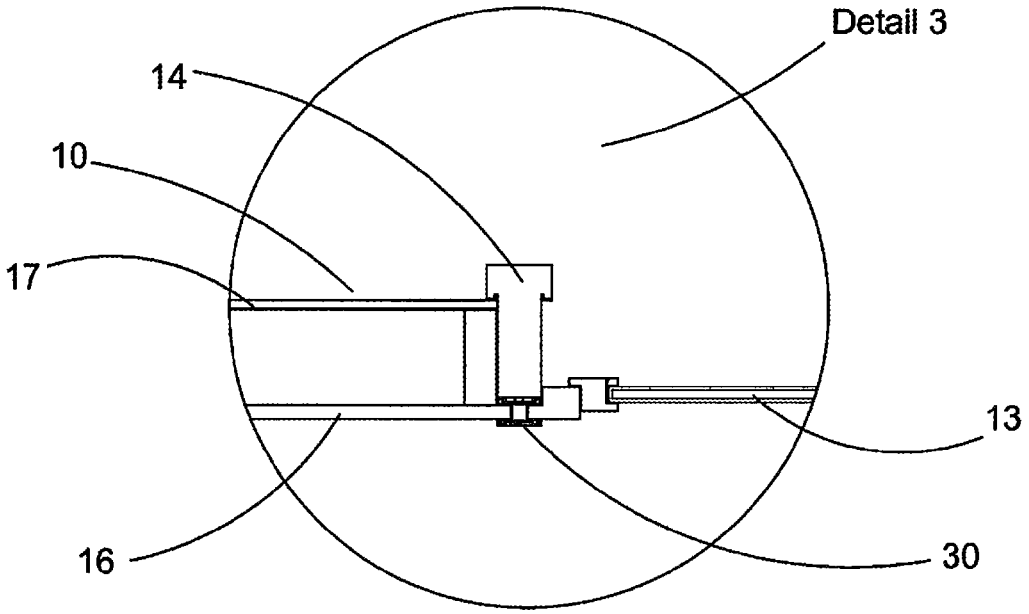
FIG. 7 shows a door/window design, vertically

FIG. 7 shows a post 14 that is on one side connected to a filling panel 10 via the fitting 30 and on the opposite side integrates the frame of a door or of a window 13.

Figure 8:
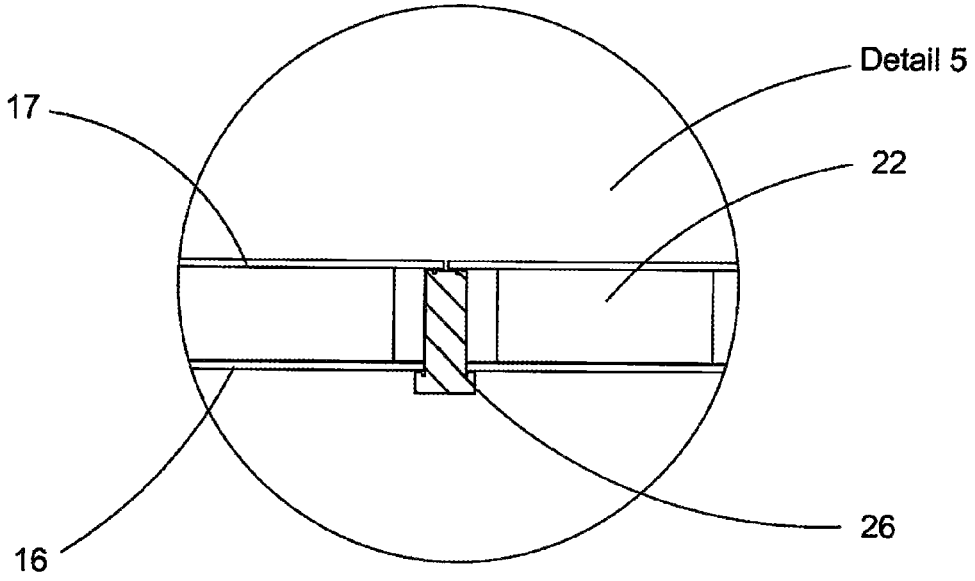
FIG. 8 shows a connection of filling panel and crossbeam.

FIG. 8 shows a detail 5 from FIG. 2, which shows the insertion of filling panels 22 into a ceiling grid formed from ceiling girders 26. No clamping fastening is required for this.

Figure 9:
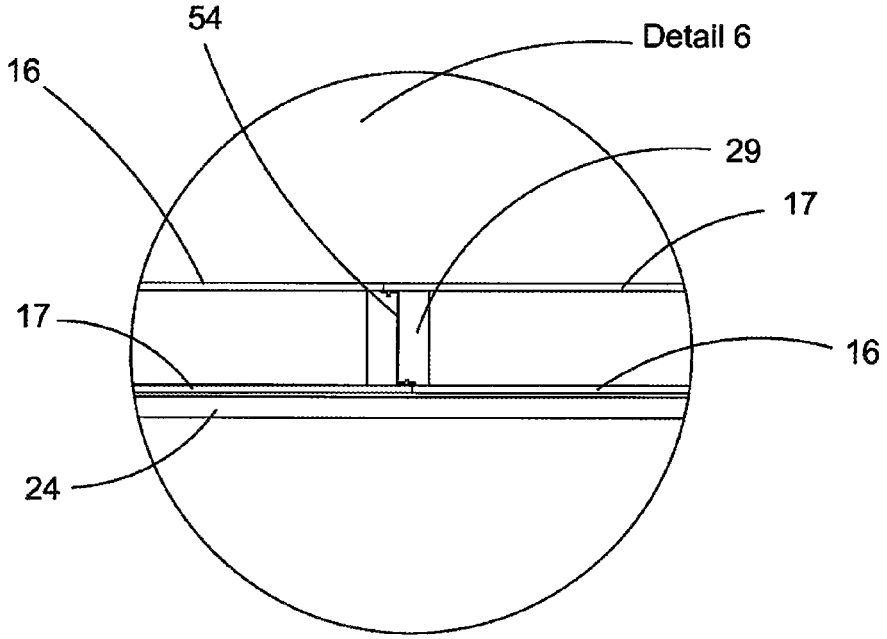
FIG. 9 shows a connection of ceiling filling elements.

FIG. 9 shows the application of filling panels onto the flange edge 24 of a ceiling girder 26. Two adjacent filling panels are each rotated by 180° in the vertical direction, so that outer cover plates 16 and inner cover plates 17 alternately lie in one plane, so that they are adjacent to each other on the ceiling filling panel butt joint 54 and thus form the ceiling.

Figure 10:
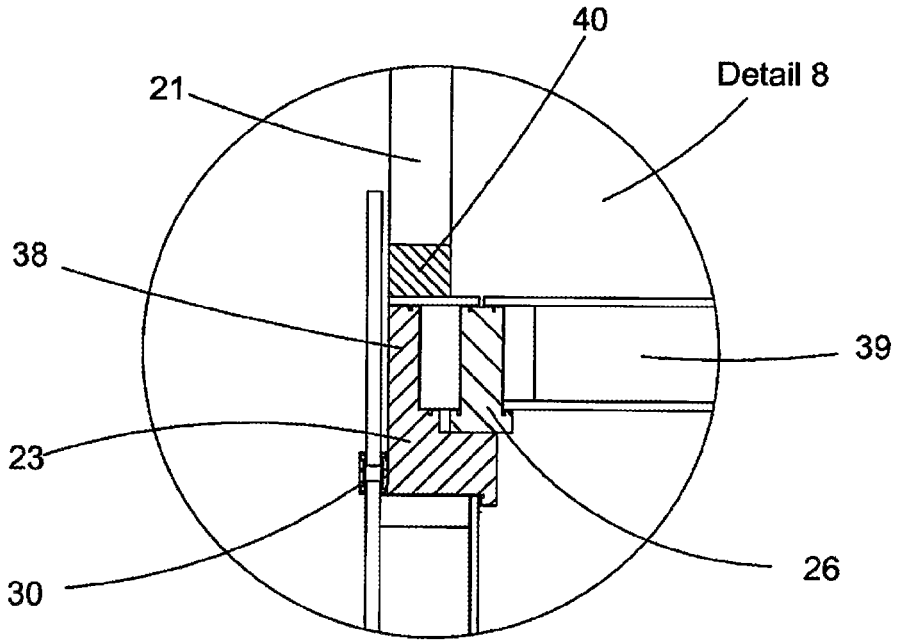
FIG. 10 shows a ceiling girder support in a longitudinal section.

FIG. 10 shows a longitudinal section through a ceiling girder support. On the plate 23, an edge beam 38 is provided, above which the eaves purlin is provided. On a shoulder of the plate 23, the ceiling girder 26 is supported, which forms the first edge-side ceiling girder of the building.

Figure 11:
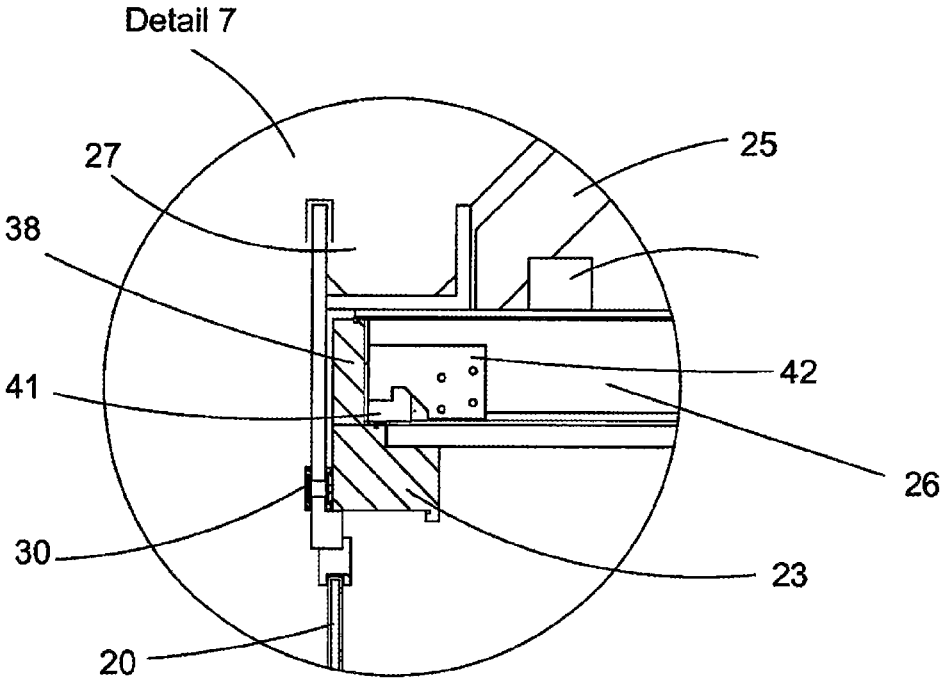
FIG. 11 shows a ceiling girder support in a transverse section.

FIG. 11 shows the detailed view 7 of FIG. 3. On the edge side of the plate 23, the edge beam 38 is located that contains on the inside thereof a first part of a hooked fitting 41. The second part 42 of the hooked fitting is fastened to the ceiling girder 26. The hooked fittings have interengaging projections that can be connected to each other by simple placement, however, it is equally simple to remove them again. The tension forces that are transferred via the hooked fitting are taken up by the recesses of the hooked fitting. At the bottom edge of the roof, a rain gutter 27 is provided.

Figure 12:
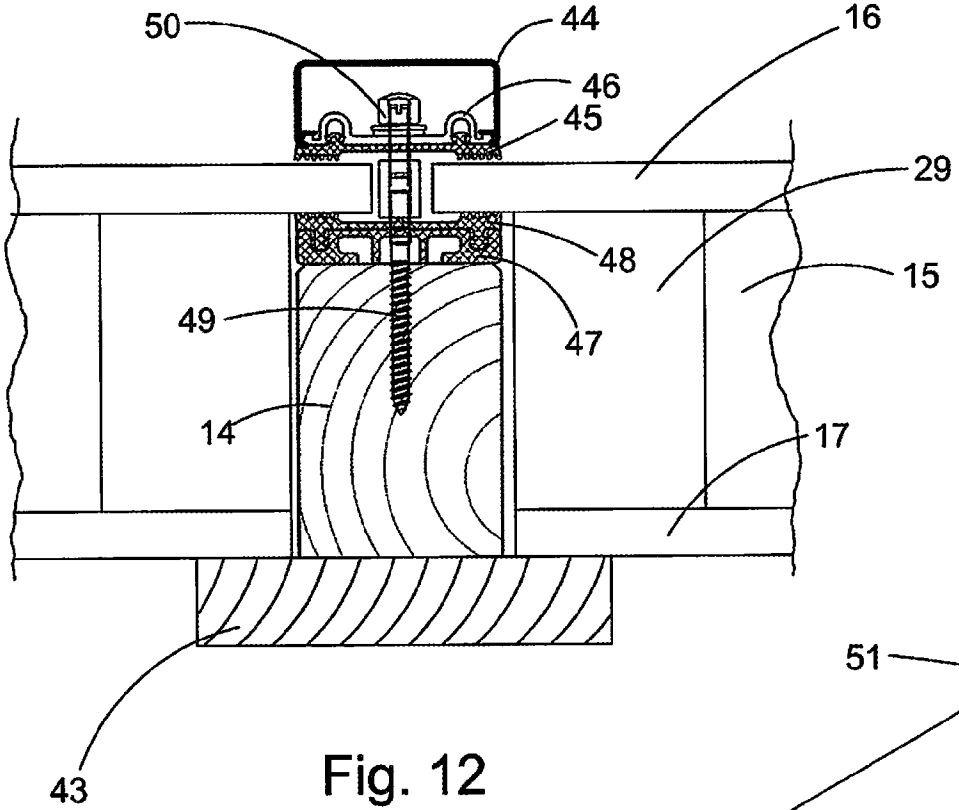
FIG. 12 shows a connection of post and filling panel.

FIG. 12 shows the connection of two filling panels with a post 14 by means of a fitting per se known in detail. Such a fitting is available for example from the Stabalux Company under the designation ZL-H. The filling panels abut with the inner cover plates 17 thereof against the inside of the flange 43, which together with the web of the post 14 forms a unit of glued wood. On the bottom side of the web, a support strip 47 with an attached inner seal 48, which strip runs along the web, is provided in such a way that the support strip 47 and the seal 48 extend between the bottom side of the web of the post 14 and the inner edge of the outer cover plates 16, with the inner seal being easily compressible. On the outside of the outer cover plate 16 abutting against each other, there is an 30 outer seal 45 and an outer strip 46. A bolt in the form of a hanger bolt 49 is passed through the seals and the strips, via which bolt the outer strip 46 can be tightened by means of a nut 50 in such a way that the outer cover plates 16 are pushed against the bottom side of the post 14 via the seals 45 and 48. The connection of the outer cover plates 16 and/or the filling panels 10 with the posts or crossbeams is therefore exclusively carried out by clamping. The outer strip 46 can, for design reasons and for protecting the nut 50, also be covered with a covering strip 44.

The connection of the outer cover plates 16 with the crossbeams is carried out in the same way as the connection of the outer cover plate 17 with the posts. Further, the windows and doors are also fastened using this type of fittings.

Figure 13:
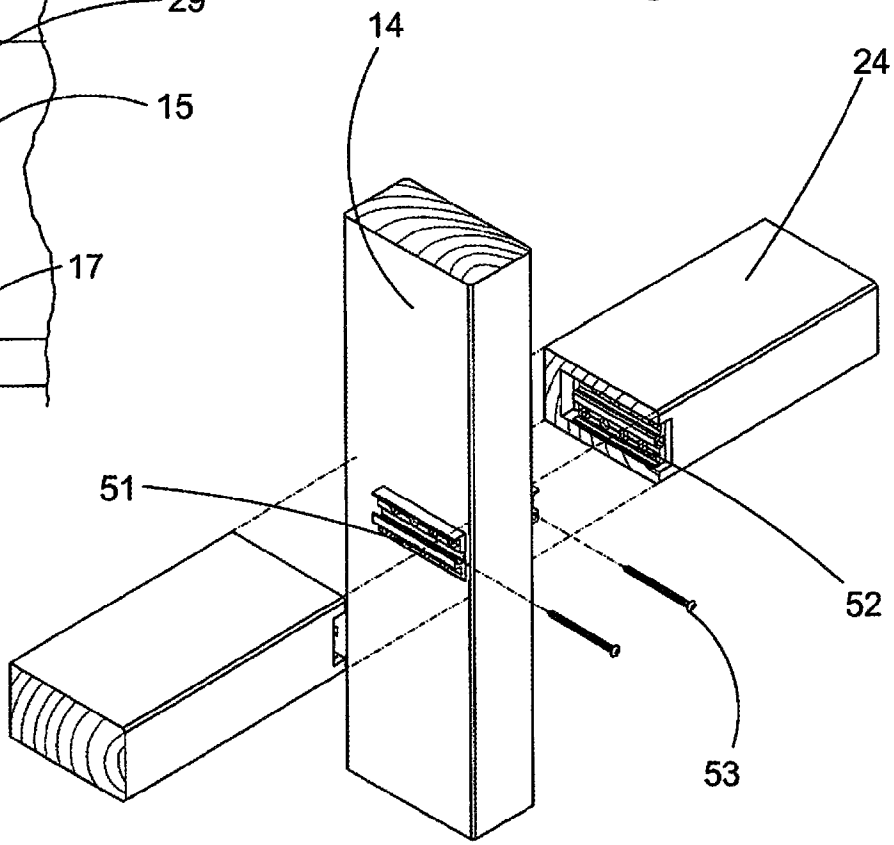
FIG. 13 shows a connection of post and crossbeam.

The connection between the posts and crossbeams to each other is carried out, according to FIG. 13, via sliding fittings per se known, wherein a part 51 of such a sliding fitting is fixed to the side of a post 14 and the other complementary part 52 of the sliding fitting is fixed to an end-side recess of the crossbeam 24. A sliding fitting of this type is produced for example also by the Stabalux Company in the system ZL-H. As a result, the crossbeams can be connected to the posts by means of lateral insertion. An adjustment screw 53 can be used to tension the connection. The connection between posts and crossbeams can then also be released.

The invention claimed is:

1. A building system in a residential building, with a skeleton structure including posts (14) and crossbeams (24) erected on a ground slab (9), the skeleton structure defining skeleton fields between posts and crossbeams and wherein the skeleton fields are provided with filling panels (10), windows (12) and doors (20), and wherein the filling panels (10), which are designed in multiple layers with an inner cover plate (17), an outer cover plate (16) and edge strips (29) running between the inner cover plate (17) and the outer cover plate (16) with an insulation (15) enclosed between them, are arranged substantially in alignment between the posts and crossbeams, each one of the posts (14) or crossbeams (24) are formed to have a T-shaped cross section including a flange and a web, the height of the web corresponding to the overall thickness of the insulation (15) and the inner cover plate (17) of the filling panels, and the flange (43) of the T-shaped posts (14) or crossbeams protrudes on the inside of the building over edges of adjacent inner cover plates (17) of the filling panels (10) so as to retain the filling panels in place, the outer cover plate of each filling panel has an outer edge that overlaps the web of adjacent posts (14) or crossbeams (24) at least in part, connecting means (30) are provided at the posts or crossbeams for connecting the posts (14) or the crossbeams (24) to the filling panels (10) located in the skeleton fields, said connecting means being formed as releasable fittings, wherein the connecting means (30) clamp the regions of the outer cover plate (16) that overlap the posts (14) or crossbeams (24) to the web of the posts (14) or crossbeams (24), and the building system is designed so that it can be disassembled.

2. The building system as claimed in claim 1, characterised in that front wall panels are provided on the upper edge (31) of the flanges (43), which panels cover the fillings panels (10) and are fastened to the flanges (43) of the posts (14) or crossbeams (24) in order to form an installation space at a distance from the inner cover plate (17) that corresponds to the flange thickness.

3. The building system as claimed in claim 1, characterised in that the walls of the building are erected on a ground slab (9) from a base crossbeam (36) at the bottom of the wall.

4. The building system as claimed in claim 1, characterised in that the walls of the building are covered at the top side thereof with a plate (23), on which plate ceiling girders (26) are supported.

5. The building system as claimed in claim 4, characterised in that ends of the ceiling girders (26) are connected to the plate (23) by means of interengaging hooked fittings (41, 42).

6. The building system as claimed in claim 5, characterised in that edge beams (38) are provided on the plate (23), wherein on the inside of the edge beam (38), a first part (41) of the hooked fitting is fastened, and on the end of the ceiling girder (26) supported on the plate (23), a second part (42) of the hooked fitting is fastened.

7. The building system as claimed in claim 6, characterised in that the plate (23) and the edge beams arranged thereon are each formed as a unit made from glued wood.

8. The building system as claimed in claim 4, characterised in that spaces between ceiling girders (26) are provided with filling panels (22).

9. The building system as claimed in claim 5, characterised in that the spaces between ceiling girders (26) are provided with filling panels (22).

10. The building system as claimed in claim 1, characterised in that the posts (14) and crossbeams (24) are made from glued wood.

11. The building system as claimed in claim 1, characterised in that the inner cover plates (17) and the outer cover plates (16) of the filling panels (10) are formed from vapour diffusive panels.

12. The building system as claimed in claim 1, characterised in that windows are inserted into some of the skeleton fields.

13. The building system as claimed in claim 1, characterised in that the connection of the posts (14) and the crossbeams (24) is carried out via sliding fittings (52) that are fastened to the crossbeams (24) at ends, the sliding fittings can be inserted into corresponding fittings (51) on the posts (14).

14. The building system as claimed in claim 13, characterised in that the releasable fittings (30) clamp the outer edges of two adjacent outer cover plates (16) or glass plates between a supporting strip (47) that covers the bottom side of the webs of the posts (14) or crossbeams (24) and is provided with an inner seal (48), and an outer strip (46) that is provided with an outer seal (45), wherein the clamping is carried out by means of a bolt (49) passed through the outer strip (46) and the supporting strip (47), which bolt is anchored in the respective post or crossbeam.

15. The building system as claimed in claim 14, characterised in that the outer strip (46) is covered with a cover strip (44).

16. The building system as claimed in claim 1, characterised in that the releasable fittings (30) clamp the outer edges of two adjacent outer cover plates (16) or glass plates between a supporting strip (47) that covers the bottom side of the webs of the posts (14) or crossbeams (24) and is provided with an inner seal (48), and an outer strip (46) that is provided with an outer seal (45), wherein the clamping is carried out by means of a bolt (49) passed through the outer strip (46) and the supporting strip (47), which bolt is anchored in the respective post or crossbeam.

17. The building system as claimed in claim 16, characterised in that the outer strip (46) is covered with a cover strip (44).

* * * * *